US005203175A

United States Patent [19]

Farrey et al.

[11] Patent Number: 5,203,175

[45] Date of Patent: Apr. 20, 1993

[54] FROST CONTROL SYSTEM

[75] Inventors: Nancy L. Farrey; William W. Hoerner, both of Dubuque; David P. Leppert, Zwingle, all of Iowa; Glenn A. Nicol, Dickeyville, Wis.

[73] Assignee: Rite-Hite Corporation, Milwaukee, Wis.

[21] Appl. No.: 870,952

[22] Filed: Apr. 20, 1992

[51] Int. Cl.[5] ..... F25D 21/12

[52] U.S. Cl. ..... 62/82; 62/156; 62/248; 62/275; 62/282; 62/265

[58] Field of Search ..... 62/156, 80, 82, 265, 62/248, 275, 282, 255, 256, 272; 165/17

[56] References Cited

U.S. PATENT DOCUMENTS

| | | | |
|---|---|---|---|
| 1,915,704 | 6/1933 | Warren | 62/248 |
| 2,558,997 | 7/1951 | Voelker | 62/265 |
| 2,706,387 | 4/1955 | Swanson | 62/248 |
| 2,827,266 | 3/1958 | Ruff | 257/9 |
| 3,025,681 | 3/1962 | Booth | 62/265 X |
| 3,186,185 | 1/1963 | Bently et al. | 62/255 |
| 3,462,966 | 8/1969 | Reid et al. | 62/248 |
| 4,009,586 | 3/1977 | Skvarenoma | 62/282 X |
| 4,109,484 | 8/1978 | Cunningham | 62/256 |
| 4,516,482 | 5/1985 | Smith | 98/36 |
| 4,855,567 | 8/1989 | Mueller | 219/218 |
| 4,950,869 | 8/1990 | Mueller | 219/218 |
| 4,977,754 | 12/1990 | Upton et al. | 62/248 |

FOREIGN PATENT DOCUMENTS 2170893A 8/1986 United Kingdom .

OTHER PUBLICATIONS

Fostoria Industries, "Infrared Snow Control At John Hancock Center" Aug. 1974.

Fostoria Industries, "Compact Mitey Midget Infrared Heater" 1989.

Fostoria Industries, "Commercial Areas" 1965.

*Primary Examiner*—Harry B. Tanner

*Attorney, Agent, or Firm*—Leydig, Voit & Mayer

[57] ABSTRACT

A frost control system is described for inhibiting and removing frost from the door of a storage locker. Relatively cool air is received by an inlet to the frost control system at an inlet placed above the door. The air is drawn into the system by a blower which forces the air through the ducts of the system. The air passes through strip heaters within the vertical ducts of the defrost system positioned on either side of the door. The warm air is discharged horizontally across the bottom portion of the door and simultaneously rises creating a blanket of relatively warm air in comparison to the ambient area. Discharge apertures are included in the ends of the vertical ducts which blow a portion of the warmed air to the base of the door to enhance coverage of the door by the warmed air.

25 Claims, 8 Drawing Sheets

H2
32
H1
30
88
89
90
91
84
78
79
80
81
82
86
94
92
86a
72
74
75
76
77
57
50
46°-50°
66
67
68
69
70
60
62
64

FROST CONTROL SYSTEM

BACKGROUND OF THE INVENTION

1. Field of the Invention

This invention relates generally to warm air frost control systems. More particularly, this invention relates to a frost control system for discharging heated air at the bottom portion of a frost controlled surface and advantageously inhibits the formation of frost on upper portions of the frost controlled surface by means of convection forces.

2. Background of the Invention

Large scale cold-storage lockers have been devised in order to accommodate the large capacity storage needs of the food industry. These lockers must accommodate the access needs of the user. As such these lockers are constructed with openings which can be easily opened and closed as well as provide an adequate barrier between the cold air compartment of the locker and the outside environment.

In order to provide easy access to a cold-storage locker compartment, various door systems have been devised depending upon the space requirements and the preferences of the user. These doors can be folding doors which are drawn laterally in a manner similar to curtains in the home. Others slide vertically in a manner analogous to the opening and closing of typical sliding garage doors while still other doors are mounted upon a vertical axis and swing open and close in the same manner as a gate. These are of course only a few examples of the many types of freezer access doors known to those skilled in the art.

A common problem associated with the aforementioned freezer door systems, regardless of their method of opening and closing, is the tendency of moisture to condense on the warm air side of the moveable freezer door. The condensation may drip to the floor of the freezer entrance resulting in a hazardous surface for persons entering and leaving the cold-storage locker. Frequently, the condensation freezes upon the hinges and other surfaces of the freezer door as well as surfaces adjacent to the door such as the floor. The accumulated frost hampers the opening and closing of the entrance to the cold-storage locker. Frosted or iced transparent door panels or windows obstruct vision to the other side of the door creating a safety hazard for persons entering and leaving the storage locker. Freezing of the joints presents the danger of locking the joints of the door. Attempts to free the locked joints may damage the freezer door. Therefore, it is advantageous to include a frost control system to prevent the condensation of water vapor upon the outer surface of the door, keep the door frost-free, maintain clear visibility through transparent portions of the door, and avoid frost buildup on the floor and other surfaces adjacent to the door.

Known systems for preventing the condensation of frost on the outside surface of a cold-storage locker door or to defrost a frost covered door have utilized radiant heat. These systems suffer from the presence of unequal application of heat upon the defrost surface. Since the amount of radiant energy incident upon the door surface is proportional to the area covered by the dispersed radiant energy, the portions of the door nearest to the heat source tend to receive too much heat while portions of the door farther away tend to receive an insufficient amount of heat to keep the door frost free. As a result, these systems are not desirable for large doors where the amount of heat per unit surface area changes greatly as one moves from the point of the door surface nearest to the heat source to the point farthest from the heat source.

Other known systems operate by blowing warm air downward and against the outer, warm-air, surface of the freezer door from a position located above the freezer door. A powerful blower is required in order to blow the warm air to the bottom of the freezer door surface since convection forces tend to halt the downward flow of the warmed air. It has been noted that such systems do not function optimally unless a second door is added to create a closed environment proximate the storage locker door in which the warm air circulates.

SUMMARY OF THE INVENTION

It is an object of the invention to remedy the defects of the prior art frost control systems.

Because warmer air is capable of holding more moisture, in order to prevent condensation of moisture and inhibit the formation of frost on the outer surface of a freezer door and adjacent surfaces, the invention provides a layer of relatively warm unsaturated air adjacent to the outer surface of the freezer door. Furthermore, it is advantageous to discharge the warmed air at the base of the outer freezer door surface in order to take advantage of the convection forces which will tend to cause the warmed air to rise and pass over the remainder of the door surface.

It is also advantageous to draw air from a relatively high position since warmer source air for the defrost system is thereby provided and therefore less additional energy is needed to heat the air to the proper temperature prior to discharge from the frost control system.

It is also advantageous to position a single blower at a central position to provide equal streams of air to either side of the freezer door. However, one may also wish to provide a separate blower for each side of the storage locker door.

It is also advantageous to blow a portion of the warmed air downward to the base of door in order to inhibit the formation of frost on the floor adjacent to the entrance of the storage locker.

Finally, it is also advantageous to position the air heaters near the discharge ports of the defrost system in order to reduce cooling of the air prior to discharge and to limit the effect of convection forces within the frost control system's air passages.

Therefore, a frost control system is described for receiving air from an inlet, drawing the received air through one or more heating elements and discharging the warmed air at the base of the outer, warm-side surface of a cold-storage locker door. The warmed air travels horizontally across the door surface due to the force of the blower and upward as a result of the convection forces incident upon the relatively warm air discharged from the frost control system.

It is preferred to receive air at a position at or near the top of the door of the cold storage locker. The air is drawn in and forced downward in a closed passage over a pair of heating units placed with one on each side of a portal enclosing the freezer door entrance. The heated air is ejected from the closed passage through apertures in the passageway horizontally and toward the surface of the cold storage locker door. Optionally, another set of apertures may be directed downward from the ends of the closed passage in order to inhibit the formation of frost on the floor adjacent to the cold storage locker.

BRIEF DESCRIPTION OF THE DRAWINGS

The appended claims set forth the features of the present invention with particularity. The invention, together with its objects and advantages, may be best understood from the following detailed description taken in conjunction with the accompanying drawings of which:

DETAILED DESCRIPTION OF A PREFERRED EMBODIMENT

The present invention provides the above advantages through a frost control system. The frost control system uses standard off-the-shelf blower, duct, and heater elements readily available to those of ordinary skill in the area of frost control systems. Air is drawn into the frost control system by means of a standard PSC or Shaded Pole Blower manufactured by Dayton Electric. Unheated air passes from the blower to a poly-vinyl chloride (PVC) T-joint having a single input and two opposing output ducts. The two opposing output ducts are connected to PVC sewer grade pipe running above the storage locker entrance. An elbow joint connects the horizontal portions of the air passageway to the vertical portions of the air passageway. The air ducts are held in place by the wraps tied around the tubing and through D-rings located on the side frames. Prior to discharge from the frost control system, the air passing down the vertical portions is heated by strip heaters, such as those produced by Wellman, installed within the vertical portions. Air passing over these heating elements attains a sufficient temperature to provide, after discharge from the frost control system, a warm layer of air over the entire surface of the cold storage locker door for inhibiting to formation of condensation and frost on the surface. The desired temperature is attained from a combination of factors including the size of door, the outside air temperature, and the flow rate of air discharged from the frost control system. The heated air is discharged from the lower section of the vertical portion of the frost control system through apertures in a direction horizontal to the base of the door and toward the door at a sufficient angle to provide a layer of warmed air along the outer surface of the storage locker door. The warmed air is forced by the frost controller horizontally across the door surface and rises vertically along the surface of the cold storage locker door due to convective forces acting upon the relatively warm air discharged from the control system. In addition to the horizontal discharge apertures, apertures are also positioned at the bottom end of each vertical portion of the frost control system which direct streams of air to the base of the door in order to inhibit the formation of frost on the floor adjacent to the storage locker and other adjacent surfaces. The warm air not only melts accumulated frost, it also inhibits the condensation of moisture on the door's warm-side surface by absorbing moisture from the surrounding air.

Figure 1:
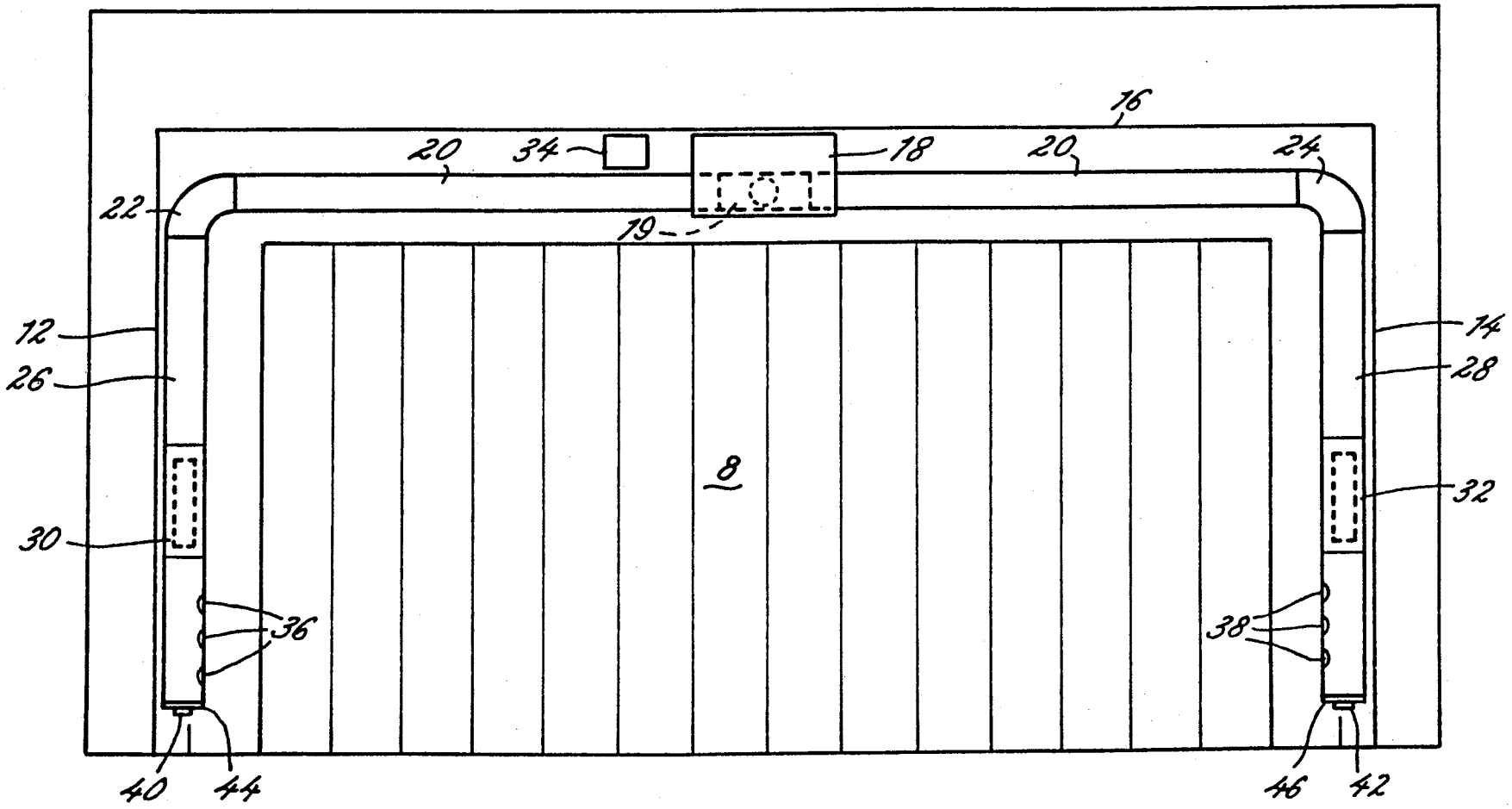
FIG. 1 is a schematic drawing of the front elevational view of the frost control system in an exemplary installation.

Referring now to the drawings, FIG. 1 illustrates a general schematic diagram of the frost control system according to the preferred embodiment of the present invention. The defrost system is mounted within a portal comprising two side frames 12 and 14, and a header frame 16.

Air is drawn into the defrost system through the inlet duct of the blower 18. In the present preferred embodiment, a Dayton Electric Manufacturing Co. 4C831A, ½ HP blower having an inlet diameter of 8 inches and outlet opening of 5.56 in. by 7.19 in. However, other suitable blowers would be known to one skilled in the art of frost control systems.

The outlet of the blower 18 is fitted to duct 20 by means of a T-joint sewer pipe fitting. In the present preferred embodiment, the duct 20 is 4 inch diameter sewer grade PVC pipe. Elbow joints 22 and 24 join the horizontal duct 20 to the vertical ducts 26 and 28 respectively. In order to prevent leakage of air, low-temperature caulk is applied to the seams created by the joints 19, 22, and 24 and the ducts 20, 26 and 28.

Figure 2:
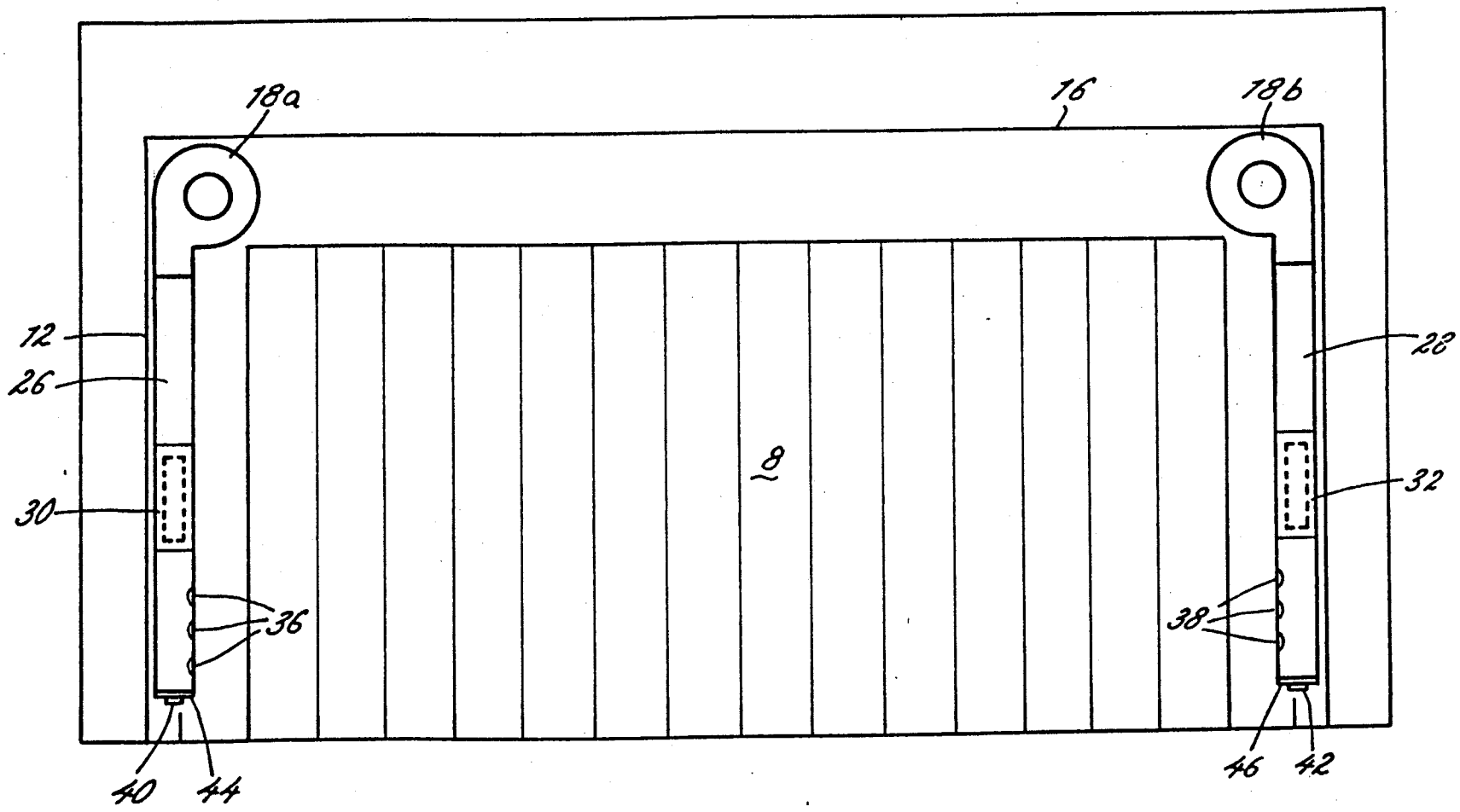
FIG. 2 is a schematic drawing of the front elevational view of an alternative frost control system containing two blowers.

Though in the present embodiment a single blower 18 is installed in the center of the header frame 16, in another embodiment illustrated in FIG. 2 two blowers 18*a*, 18*b* are positioned in the header frame 16 directly above the heating elements 30 and 32 respectively. In this embodiment, there is no need for the elbow joints 22 and 24 or the horizontal duct 20. It is believed that the providing of a more direct path to the heater units and the air outlets of the frost control system provides advantages not achieved by using a single blower 18 as shown in the present embodiment. However, it does require doubling the number of blowers and increasing the complexity of the electrical system of the frost control system.

Figure 3A:
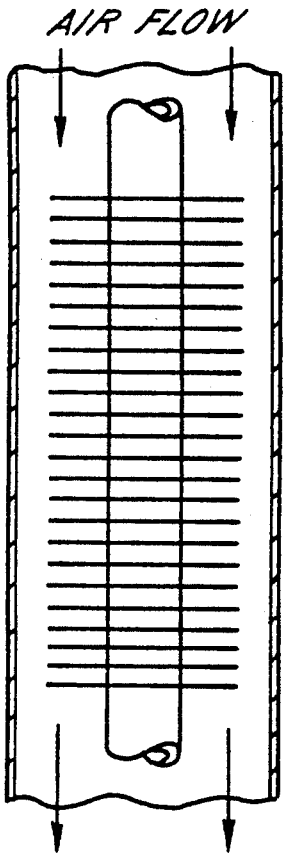
FIGS. 3*a* and 3*b* are illustrations of two heater configurations.
Figure 3B:
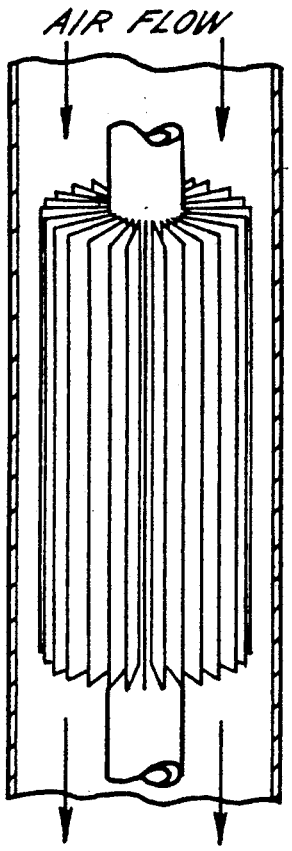

Next, strip heaters 30 and 32 are installed within the lower sections of the vertical ducts 26 and 28 respectively. In the present embodiment, the heaters 30 and 32 are Wellman FS2061 1900 Watt strip heaters having radiating fins displaced tangentially to the flow of air downward in the ducts 26 and 28. However, it would be preferred to have the fins placed parallel to the flow of air—if such a product were available—in order to minimize the disruption of airflow in the ducts 26 and 28. The placement of the radiating fins tangentially and in parallel to the flow of air is illustrated in FIGS. 3*a* and 3*b* respectively.

In order to provide heat insulation between the strip heaters 30 and 32 and the sidewalls of the PVC ducts 26 and 28, the heaters 30 and 32 are enclosed within a double-walled tin pipe. Also, in respect to the electrical wiring, the power wires are contained within the ducts 26 and 28 and run from the heaters 30 and 32 to the elbow joints 22 and 24 respectively. In the present embodiment, the power wires for the strip heaters 30 and 32, protected by plastic grommets, emerge from the ducts at holes drilled in the elbow joints 22 and 24 for such a purpose. However, the point at which these wires emerge from the duct is merely a design consideration and other emergence points would be known to those of ordinary skill in the art. The wires are then routed to the junction box 34 which thermostatically controls the operation of the frost control system. The operation of the junction box 34 is described in greater detail hereinafter.

Figure 4:
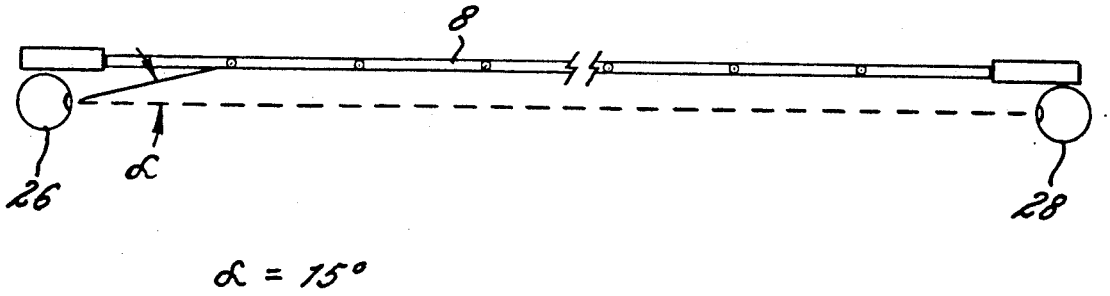
FIG. 4 is a top plan view of the vertical ducts illustrating the positioning of the discharge apertures of the frost control system.

The heated air emerges from the bottom of the heater strips 30 and 32 and passes to the lowest portion of the vertical ducts 30 and 32. The heated air is discharged from the ducts 26 and 28 through sets of apertures 36 and 38 which are one inch in diameter and positioned such that the stream of heated air discharged horizontally out of the apertures 36 and 38 is slightly directed toward the storage locker door surface. As shown in the aerial view in FIG. 4, if one were to draw a horizontal beam parallel to the door, the predetermined angle alpha created by the direction of the stream of heated air and the horizontal beam preferably is about 15 degrees. If desired, collimating means such as cylinders or other nozzles may be mounted along parallel axes parallel to the floor surface and directed inwardly at the desired angle, alpha. The preferred temperature range of the heated air at the time of discharge from the frost control system is between 70 and 80 degrees Fahrenheit. The temperature, relative humidity, volume of heated air, and velocity of air at the apertures, are some of the parameters which may be adjusted to prevent frost from accumulating on the surfaces of the door.

In the preferred embodiment, each set of apertures 36 and 38 includes a set of 10 holes each approximately 1 ¼ inches in diameter. The lowest hole for discharging the warmed air horizontally is 22 inches from the base of the door 8. The holes should be evenly spaced having edges spaced approximately ½ inch apart. The number of holes as well as their size, shape, and spacing may be varied to some extent while providing essentially the same function as the apertures provided in this present described embodiment.

Furthermore, additional apertures 40 and 42 are included in the end caps 44 and 46 respectively. Alternatively, the bottom ends of ducts 26 and 28 may be left uncapped. The venting of warm air out the bottom of the ducts 26 and 28 ensures that the warm air substantially is applied over the entire surface of the door 8, and especially the bottom portions of the door 8 and the surrounding surfaces. The volume of warm air circulated also is thereby increased.

It will be understood that the location of the blower inlet helps to circulate warm air from the apertures across the door surfaces to the top of the door, where at least a portion of the warm air is recirculated into the blower system.

Though the present embodiment utilizes 4 inch diameter PVC sewer pipe, other suitable duct materials would be known to those of ordinary skill in the art. Furthermore, the dimensions of the ducts 20, 22 and 24 may be altered to suit the dimensions of any particular size door frame.

Figure 5:
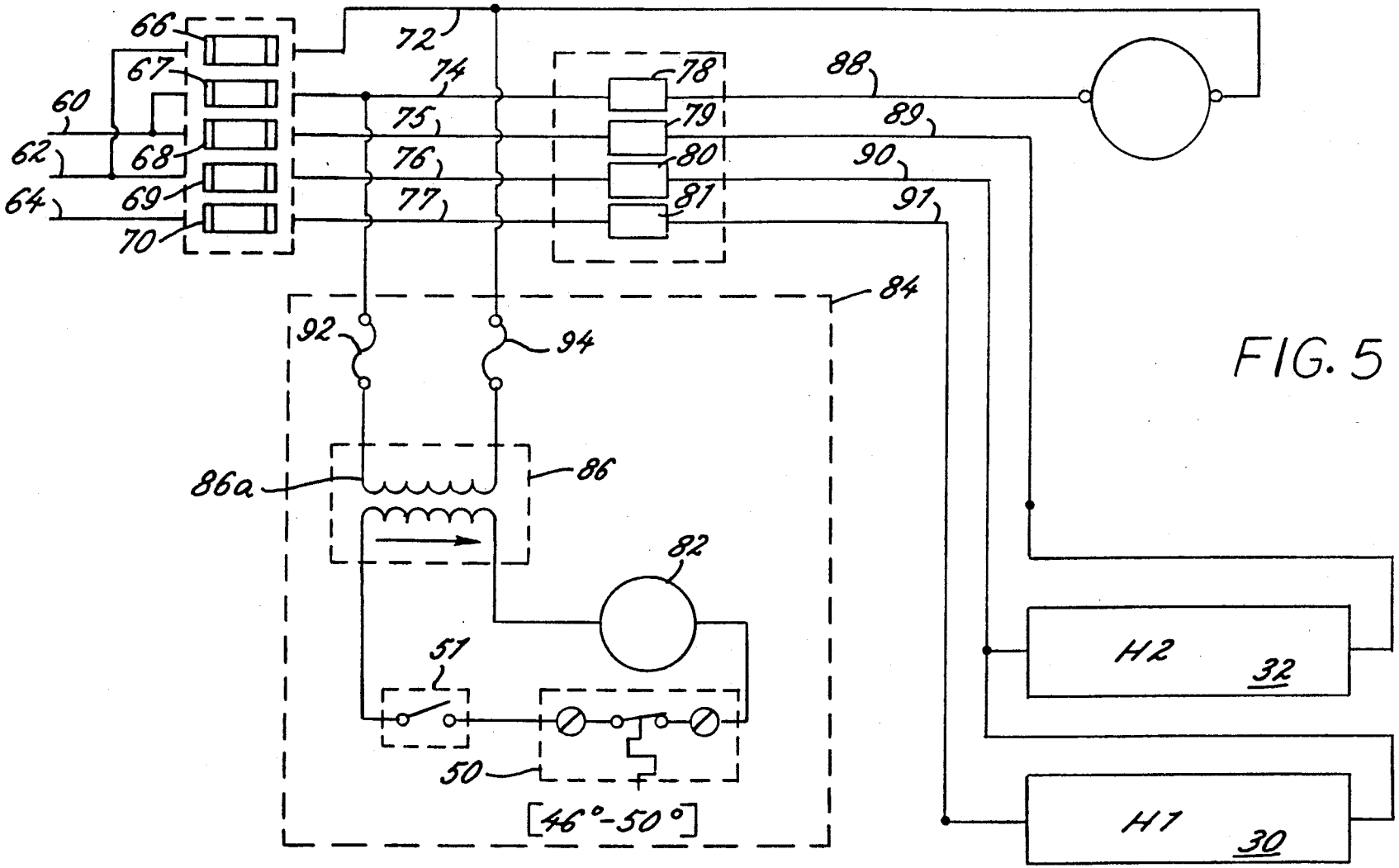
FIG. 5 is a schematic drawing of the electrical system for the frost control system.

A control system is included in the present invention in order to operate the frost control system only under the conditions when frost is likely to form on the outer, warm air, surface of the door 8. Turning now to FIG. 5, the electrical system, including the thermostatic control, is schematically illustrated. A thermostat 50 is mounted at the inlet port of the blower 18. When the temperature falls below 46 degrees Fahrenheit, the thermostat control closes the circuit operating the frost control system and the blower 18 and heating units 30 and 32 are switched on. Once the frost control system is enabled, the system will not shut off until a temperature of 50 degrees is sensed at the thermostat 50.

Turning again to the electrical system illustrated in FIG. 5, the system is powered by three-phase 240 Volt AC power lines 60, 62, and 64. The power lines 60, 62 and 64 are connected to fuses 66–70 to provide circuit protection for the heaters 30 and 32 and the blower 18. Line 72 provides power from the fuse 66 to the blower 18. Lines 74–77 connect the outputs of fuses 67–70 to magnetic relays 78–81.

The relays 78–81 are energized and thus closed when a coil 82 is energized. A thermostatic control circuit 84 for the frost control system includes a step down transformer 86 for converting the 240 Volt AC potential to 120 Volts AC. The control circuit 84 is connected in parallel to the lines 72 and 74 which provide power to the blower 18. Therefore, system protection is provided by preventing the energizing of the heating elements 30 and 32 any time power is not provided on lines 72 and 74 to operate the blower 18. Such protection is indeed desirable since severe overheating of the system would occur if the heaters 30 and 32 were energized without the blower 18 circulating air through the frost control system.

The thermostat 50 is connected in series with the coil 82. It necessarily follows that the thermostat 50 disrupts the flow of current to the coil 82 and thus causes the opening of the magnetic relays 78–81 when the sensed temperature reaches a predetermined temperature where condensation is not likely to form upon the warm-side surface of the door. In the preferred embodiment the frost control system shuts off when a temperature of 50 degrees Fahrenheit is sensed.

On the other hand, the circuit closes when a predetermined temperature is sensed where condensation is likely to form on the warm-side surface of the door. In the preferred embodiment, the thermostat 50 closes the circuit 85 thus energizing the coil 82 when the sensed temperature reaches 46 degrees Fahrenheit. The energized coil 82 closes the magnetic relays 78–81 thus energizing the heaters 30 and 32 and the blower 18.

When the contact 78 is closed, current flows on line 88 to the blower 18. This energizes the blower 18 which then begins drawing air into and through the frost control system. Simultaneously with the closing of the magnetic relay 78, relays 79–81 close thus allowing current to flow on lines 89–91 which provides current to the heaters 30 and 32. The voltage on each of the lines 89–91 has a maximal value of 240 Volts and each line is out of phase with the other two lines by 120 degrees.

Two fuses 92 and 94 are included in the thermostatic control circuit 84 on either end of the 240 Volt AC primary coil **86*a* of the step down transformer 86. These fuses are connected to lines 72 and 74 of the power supply circuit illustrated in FIG. 4**.

Figure 6:
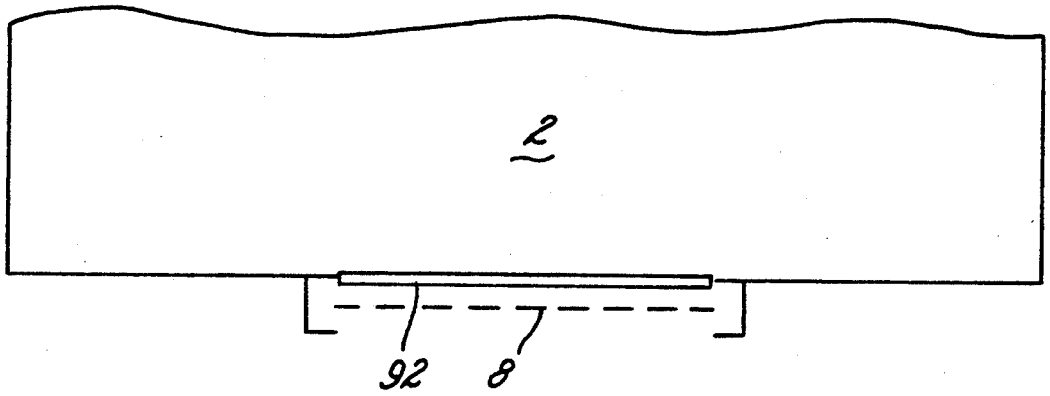
FIG. 6 is a top plan view of a storage locker having an inner and outer door.

Though an illustrative embodiment of the electrical and control system has been disclosed, additional elements and modifications may be made to the circuit in order to account for particular characteristics of the door system for which the frost control system is being provided. For example, as illustrated in FIG. 6, the storage locker 2 may include an inner door 92 which provides additional insulation helpful when the frost controlled door is not in use. At such times, the frost control system is not needed. It is therefore advantageous to add another switch 51 in series with the thermostat 50 as shown in FIG. 5 to cut off power to the frost control system when the inner door is closed.

Figure 7:
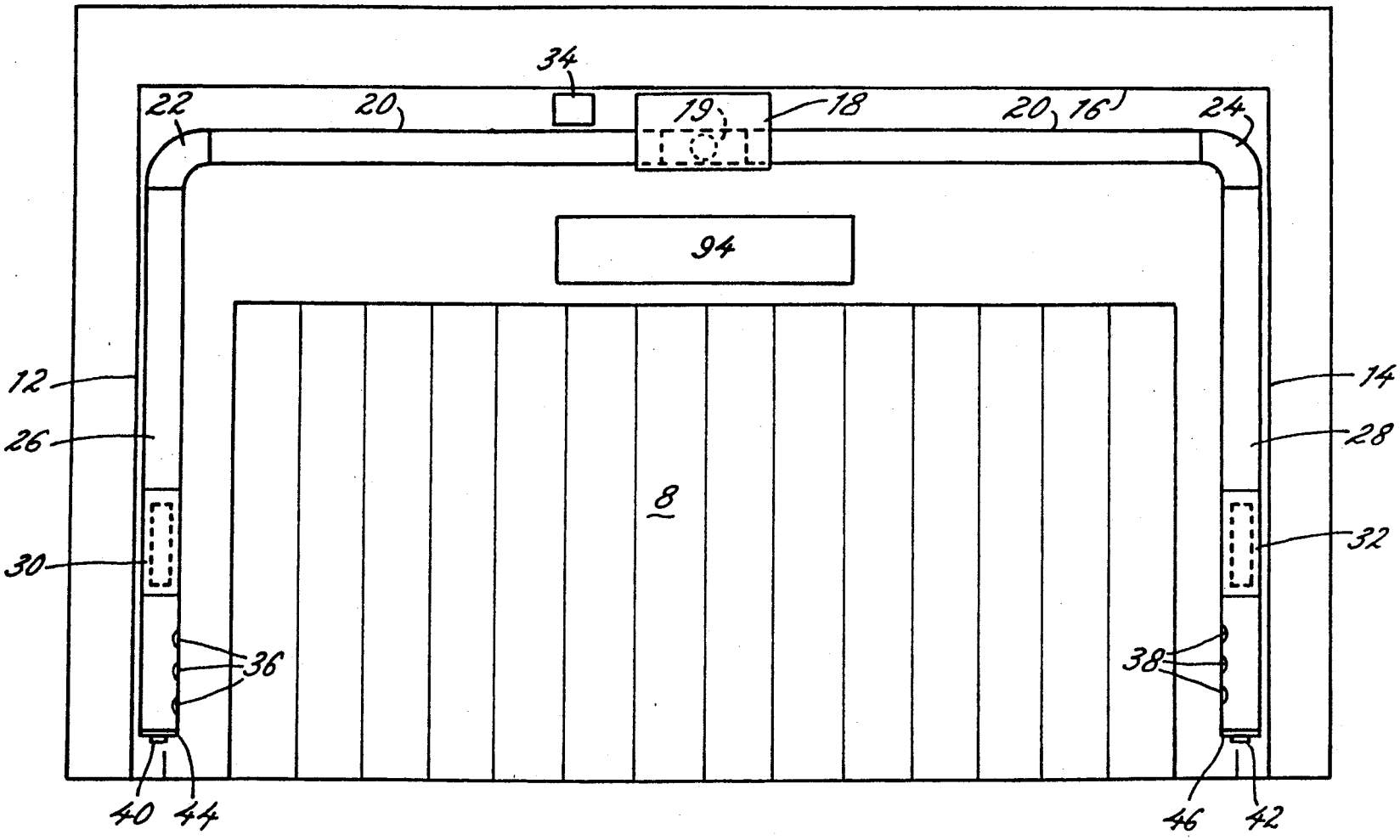
FIG. 7 is a schematic drawing of the front elevational view of the frost control system in an alternative embodiment utilizing both warm air and radiant heat.

Furthermore, much wider doors may pose problems regarding frost control coverage of the entire door surface. It may thus be advantageous to augment the presently described frost control system with a radiant heater 94 as are known to those of ordinary skill in the area of frost control systems. This alternative configuration is shown in FIG. 7. The remainder of the defrost system is substantially the same as the system described above in connection with FIG. 1. Appropriate changes are made to the electrical subsystem illustrated in FIG. 5 as is known to those of ordinary skill in the art.

Figure 8:
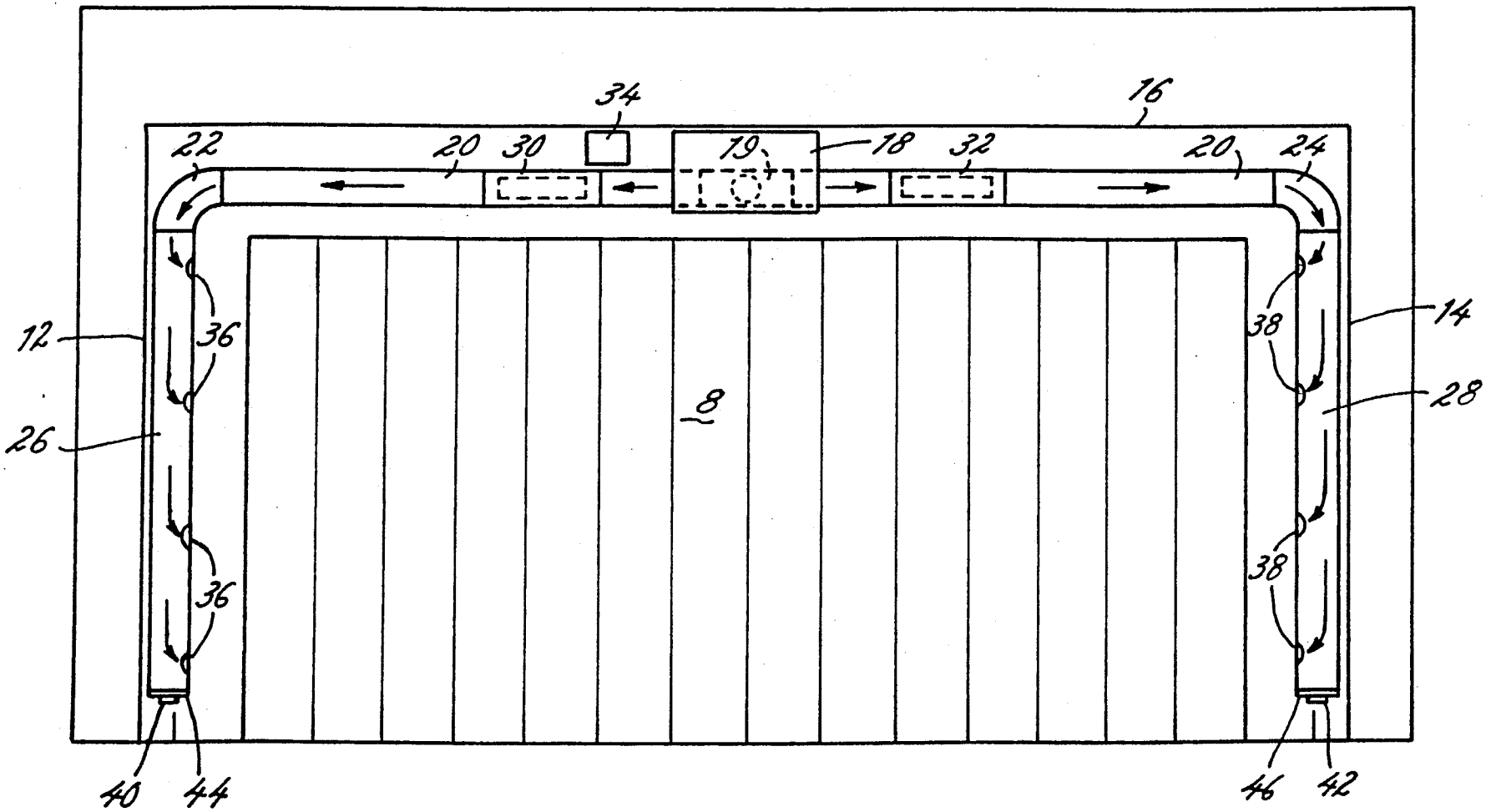
FIG. 8 is a schematic drawing of the front elevational view of the frost control system in an alternative embodiment wherein the horizontal discharge apertures are spaced along both the upper and lower portions of the vertical air passageway.

Turning now to FIG. 8, an alternative defrost system is illustrated wherein the discharge apertures 36 and 38 are disposed along both the upper and lower portions of the vertical ducts 26 and 28. The position of the heater strips 30 and 32 is adjusted so that the air passes through the heater strips 30 and 32 before leaving the defrost system through the apertures 36 and 38. The remainder of the defrost system is substantially the same as the system described above in connection with FIG. 1.

Figure 9:
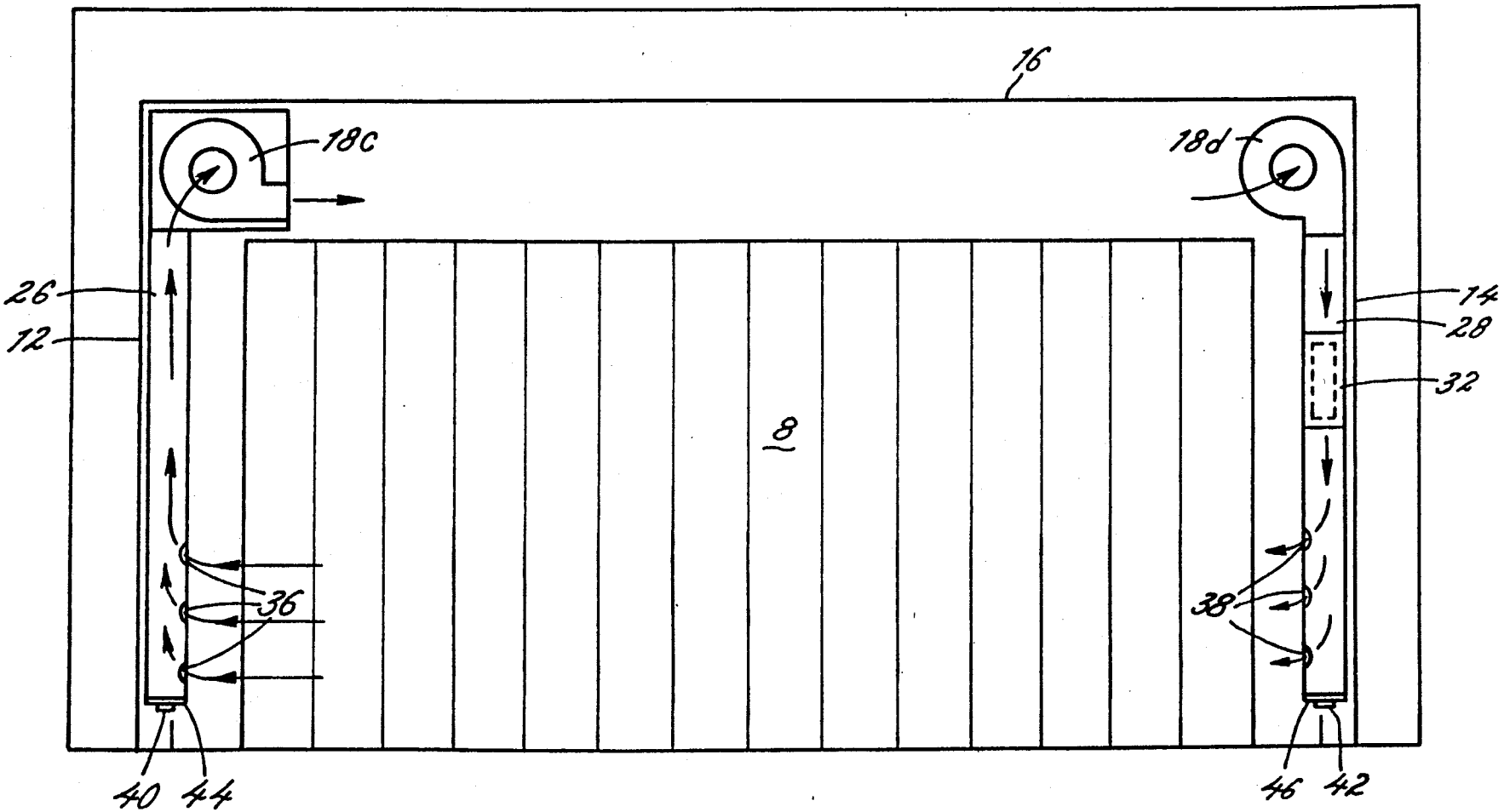
FIG. 9 is a schematic drawing of the front elevational view of the frost control system in an alternative embodiment containing discharge apertures on one side of the door and suction apertures on the opposing side of the door.

Turning finally to FIG. 9, an alternative defrost system is illustrated wherein air is drawn into the defrost system by the blower 18*d*, passes over heater strip 32 and is discharged through apertures 38. Blower 18*c* creates a vacuum in duct 26. The vacuum draws air into the duct 26 through apertures 36. The right portion 98 of the frost control system discharges air and the left portion 99 draws air from the area in front of the door 8. The coordinated operation of the right portion 98 and left portion 99 creates a horizontal current of warm air across the door 8. Appropriate changes are made to the electrical sub-system illustrated in FIG. 5 in a manner as is known to those of ordinary skill in the art.

The preferred embodiment of a frost control system has been described. It would of course be obvious to one of ordinary skill in the area of frost control systems to make certain modifications to the afore-described system which would be within the scope and spirit of the invention described in the claims appended hereinafter. Such changes might entail modifying the blower configuration so that more than one blower is used to blow air from a relatively high inlet to a heater and discharge aperture below the inlet. The size, shape and quantity of the air discharge apertures may be modified to suit individual preferences.

What is claimed is:

1. A frost control system for removing from and preventing the formation of vapor condensation and/or frost upon a cold storage locker door having a top, a base, first and second side edges, a cold-side surface and a warm-side surface, said system comprising:

air intake means for drawing air into the frost control system;

heater means for warming said air;

transfer means coupled with said air intake means and said heater means for transporting said air from said intake means to said heater means; and air discharge means disposed adjacent to said first side edge of the door for receiving a volume of warm air from said heater means and discharging said volume of warm air across said warm-side surface in a direction having a horizontal component.

2. The system of claim 1 wherein said air discharge means is disposed adjacent to each of said first and second side edges of said door.

3. The system of claim 2 wherein said air discharge means comprises first and second duct means respectively disposed adjacent to said first and second side edges; said first and second duct means each having at least one aperture for emitting said volume of warm air.

4. The system of claim 3 wherein said at least one aperture is disposed at a relatively lower portion of said door.

5. The system of claim 2 wherein said air intake means comprises at least a first blower having an air inlet disposed proximate the top of said door.

6. The system of claim 5 wherein said air intake means further comprises a second blower having an air inlet disposed above the top of said door.

7. The system of claim 6 wherein said first and second blowers are respectively disposed adjacent to said first and second side edges.

8. The system of claim 1 wherein said air discharge means blows said volume of warm air toward said warm-side surface at a pre-determined angle to provide desired coverage of said warm-side surface by said volume of warm air.

9. The system of claim 8 wherein said pre-determined angle equals approximately 15 degrees-from-parallel to said warm-side surface.

10. The system of claim 1 wherein said heater means comprises a first heater strip having a plurality of fins disposed tangentially to the flow direction of said volume of air over said first heater strip.

11. The system of claim 1 wherein said heater means comprises heater strip having a plurality of fins disposed in parallel to the flow direction of said volume of air over said first heater strip.

12. The system of claim 1 further comprising control means for energizing and de-energizing said frost control system and wherein said frost control system is energized when an air temperature proximate said warm-side surface falls below a first pre-determined threshold and wherein an energized frost control system is de-energized when an air temperature proximate said warm-side surface exceeds a second pre-determined threshold.

13. The system of claim 12 wherein said air temperature is sensed from said air drawn by said intake means.

14. The system of claim 13 wherein said first predetermined threshold equals 46 degrees Fahrenheit.

15. The system of claim 14 wherein said second predetermined threshold equals 50 degrees Fahrenheit.

16. The system of claim 5 further comprising means for disabling said frost control system if said first blower is not receiving power.

17. The system of claim 16 wherein said control means further comprises means for disabling said frost control system when an inner door disposed between a freezer compartment and said door is closed.

18. The system of claim 4 further comprising a first radiant heater disposed above and in front of said door.

19. The system of claim 3 wherein said duct means further include a second opening at the end of each of said duct means for directing a second volume of said warm air from said heater means downward toward said base.

20. The system of claim 1 further comprising air suction means disposed adjacent to said second side edge for enhancing the flow of said volume of warm air across said warm-side surface.

21. The system of claim 1 further comprising nozzle means coupled to said air discharge means for directing said volume of warm air in a pre-determined direction.

22. A frost control system for a door having a top, a base, first and second side edges, a cold-side surface and a warm-side surface, said system comprising:

air intake mans for drawing air into the frost control system;

heater means for warming said air;

transfer means coupled with said air intake means and said heater means for transporting said air from said intake means to said heater means; and air discharge means disposed proximate said first side edge for receiving a first portion of air from said heater means and discharging said first portion across said warm-side surface in a direction having a horizontal component.

23. A frost control system for a door disposed in an opening in an enclosure wall separating a volume of relatively warm fluid from a volume of relatively colder fluid wherein header means and side wall means extend outwardly from said wall into said volume of relatively warm fluid adjacent said opening and above a floor means, said system comprising:

fluid intake means for drawing fluid from said volume of relatively warm fluid from the vicinity of said header, heater means for warming the fluid drawn by said intake means, and fluid discharge means for discharging the fluid from said heater means into the vicinity of said floor means toward said opening and away from said side wall means whereby said fluid from said discharge means will rise along said door between said side wall means for frost control purposes.

24. A frost control system for removing from and preventing the formation of vapor condensation and/or frost upon a cold storage locker door having a top, a base, first and second vertical edges, a cold-side surface and a warm-side surface, said system comprising:

air intake means adapted to be disposed adjacent the top of the locker door for drawing from the warm-side door surface a volume of air into the frost control system;

air distribution means extending from said air intake means;

heater means disposed within said air distribution means for warming said volume of air;

air discharge means mounted on said air distribution means downstream of said heater and adapted to be disposed adjacent a lower portion of at least one vertical edge of the door for discharging a volume of heated air across said warm-side surface.

25. A method of frost control to reduce frost formation on a cold storage locker door having a cold-side surface and a warm side surface, and a header and side walls extending from adjacent said door on the warm side, said method comprising the steps of withdrawing air from the vicinity of said warm side surface adjacent said header, heating the withdrawn air, transporting said air to the vicinity of the bottom said side wall and said door on said warm side, and discharging said air from said heater means along said warm side surface.

* * * * *